United States Patent [19]

Miller

[11] 4,420,161

[45] Dec. 13, 1983

[54] ROTOR STABILIZING LABYRINTH SEALS FOR STEAM TURBINES

[75] Inventor: Edward H. Miller, Rexford, N.Y.

[73] Assignee: General Electric Company, Schenectady, N.Y.

[21] Appl. No.: 376,247

[22] Filed: May 10, 1982

[51] Int. Cl.[3] ..... F16J 15/44; F16J 15/40; F01D 5/20

[52] U.S. Cl. ..... 277/56; 277/134; 415/172 A; 415/176

[58] Field of Search ..... 277/53-57, 277/134; 415/170 R, 170 A, 172 R, 172 A, 175, 176

[56] References Cited

U.S. PATENT DOCUMENTS

| | | | |
|---|---|---|---|
| 790,744 | 5/1905 | Parsons | 277/53 |
| 1,810,370 | 6/1931 | Ray | 277/56 |
| 3,594,010 | 7/1971 | Warth | 277/53 |
| 4,273,510 | 6/1981 | Ambrosch et al. | 415/119 |

FOREIGN PATENT DOCUMENTS

| | | | |
|---|---|---|---|
| 494347 | 3/1930 | Fed. Rep. of Germany . | |
| 650759 | 9/1937 | Fed. Rep. of Germany . | |
| 2000314 | 7/1971 | Fed. Rep. of Germany . | |
| 812092 | 1/1937 | France . | |
| 135949 | 12/1919 | United Kingdom | 277/56 |
| 272497 | of 1928 | United Kingdom | 277/56 |
| 465087 | 4/1937 | United Kingdom | 277/56 |

OTHER PUBLICATIONS

NASA Conference Publication 2133, "Flow Induced Spring Coefficients of Labyrinth Seals for Application in Rotor Dynamics", May 12-14, H. Benckert et al.

*Conference on Vibrations in Rotating Machinery* I. Mech. E., Sep. 15-17, 1976 "Investigations into Load Dependent Vibrations of the High Pressure Rotor On Large Turbo-Generators", S. H. Greathead et al.

Paper No. C258/80 "Flow Induced Spring Constants of Labyrinth Seals", H. Benckert et al., 1980.

Paper No. C283/80 "Spring and Damping Coefficients of the Labyrinth Seals", M. Kurohashi et al., 1980.

Paper No. C311/80 "Further Investigations into Load Dependent Low Frequency Vibration of The High Pressure Rotor on Large Turbo-Generators", S. H. Greathead et al., 1980.

*2nd International Conference on Vibrations in Rotating Machinery* I. Mech. E., Sep. 1-4, 1980, Paper No. C258/80 "Flow Induced Spring Constants of Labyrinth Seals", H. Benckert et al.

*Primary Examiner*—Robert S. Ward, Jr.

*Attorney, Agent, or Firm*—Robert C. Kain, Jr.; John F. Ahern

[57] ABSTRACT

Labyrinth sealing apparatus to prevent rotational instability in the rotor of a steam turbine wherein such instability is of the type induced by steam whirl within the labyrinth seals. In a preferred form, the apparatus includes a plurality of fixed, spaced-apart annular teeth surrounding the shaft of a steam turbine whereby each tooth has a radially inner edge in very close proximity to the rotor surface, and further includes a fixed circumferential row of spaced-apart flow directing vanes encircling the rotor on the upstream side of the annular teeth. Each vane of the row extends radially inward to within very close proximity of a raised annular land on the shaft surface just opposite the vane row. The row of flow directing vanes and the raised land cause substantially the entire quantity of steam which enters the seal to pass through the row of flow directing vanes. Steam flow within the seal is caused to have a retrograde component counter to the direction of shaft rotation. This produces stabilizing forces on the rotor to neutralize destabilizing forces.

10 Claims, 4 Drawing Figures

ROTOR STABILIZING LABYRINTH SEALS FOR STEAM TURBINES

The present invention pertains generally to labyrinth sealing apparatus of the type used in steam turbines to minimize steam leakage between regions of differential pressure through which the turbine rotor extends and pertains particularly to labyrinth sealing apparatus which is operative to prevent rotor destabilization caused by steam whirl within such seals.

BACKGROUND OF THE INVENTION

Non-contacting packing ring labyrinth seals are conventionally used in steam turbines at various axial locations along the turbine rotor to seal against excessive steam leakage between regions of differential pressure. These packing ring seals typically include a plurality of spaced-apart annular teeth extending radially inward from the turbine casing to within close proximity of the rotating surface, leaving only a very small working clearance between each ring and the rotating part. This type of seal is very effective and is utilized both to prevent steam from leaking out around the shaft and to prevent leakage between stages of the turbine where the shaft passes through the diaphragms.

A certain amount of steam continuously enters and exits the packing ring structure with a flow component generally along the shaft in an axial direction. However, the steam flow also has a component in the circumferential direction, in a whirling pattern. This steam whirl results from two principal causes. First of all, steam enters the seal structure with a whirl component imparted by the most adjacent upstream turbine stage; and secondly, the drag effect of the rotating shaft produces a circumferential flow component. Although the latter frictional component is always in the direction of rotor rotation, the entering whirl may be in either direction depending on the operating parameters of the stage of the turbine immediately upstream from the seal. On turbines with double flow first stages, for example, it is known that the turbine stage that supplies steam to the end packing seals produces a forward running whirl (i.e., in the direction of shaft rotation) at high loads.

Steam flow within a seal structure is known to produce lateral forces on the turbine rotor due to asymetrical pressure gradients which arise in the sealing chambers. In some cases, where it is known that forward whirl within the shaft end seals is very strong, the turbine rotor begins to experience rotational instability related to the whirl conditions. In particular, in turbines of the double flow type mentioned above, there is a susceptability to rotational instability at higher load levels associated with forward steam whirl within the seals. In some installations it has been necessary to limit the load on the turbine to avoid destructive levels of vibration. It is generally the case that load related instabilities are discovered only after turbine installation is complete and when full load cannot then be satisfactorily attained. Thus, in seeking methods and apparatus to alleviate these problems, it has been particularly desirable to provide means which can be installed in the field as a "retrofit" without extensive modifications to the turbine and without prolonged turbine downtime.

The cause-effect relationship between fluid whirl in labyrinth seals and rotational instability has been investigated on a theoretical basis by numerous workers in the field, but to little practical effect. One attempt to deal with the problem (although not necessarily from a retrofit viewpoint) is shown by U.S. Pat. No. 4,273,510 to Ambrosch et al which appears to seek reduction of lateral forces in the seals by introducing a second fluid flow (presumably steam) into the seal in such a manner that the lateral forces are negated. While the exact dimensions of the Ambrosch et al disclosure are difficult to determine, it appears that this second flow is in addition to, or is perhaps an alternative to, the use of axial baffles in the seal gap between the rotor and stationary elements. The stated purpose of the baffles is to modify the rotary flow of fluid in the gap to negate the lateral forces. The structure and precise manner in which the apparatus of Ambrosch et al functions appears to be complex and not readily adaptable to be retrofitted to an installed turbine. In particular, if the apparatus of Ambrosch et al requires the introduction of a second steam flow to function properly, implementation after turbine installation would not be without difficulty.

Accordingly, it is a general object of the present invention to provide labyrinth sealing apparatus which is effective to prevent rotational instability in the rotor of a steam turbine wherein such instability is of the type inducible by steam whirl within the labyrinth seals.

Another object of the invention is to provide apparatus by which steam flow within at least a portion of a steam turbine labyrinth seal is caused to flow in a retrograde direction counter to the direction of rotor rotation thereby producing a stabilizing lateral force on the rotor to offset other destabilizing rotor forces which may be present but which cannot be readily eliminated or reduced.

More particularly, it is among the objects of the present invention to provide a labyrinth seal apparatus for a steam turbine which overcomes those problems outlined above, which is simple and easy to install as a retrofit to turbines experiencing such instabilities, and which does not rely on the introduction of a second steam flow to achieve its function.

SUMMARY OF THE INVENTION

These and other objects are attained by providing a labyrinth seal which, in a preferred form, includes a plurality of fixed, spaced-apart annular teeth surrounding the rotor or shaft of a steam turbine in a manner whereby each tooth has a radially inner edge in very close proximity to the rotor surface, and which further includes a fixed circumferential row of spaced-apart flow directing vanes encircling the rotor adjacent to the higher pressure or upstream side of the annular teeth. Each vane of the row extends radially inward to within very close proximity of a raised annular land on the rotor or shaft surface just opposite the vane row. Chambers are thus defined by the structure and formed as the spacing between annular teeth. The labyrinth seal (comprising the row of vanes, the raised land, and the row of annular teeth) is, of course, located between regions of differential pressure so that the seal separates a higher pressure region from one of lower pressure.

Operatively, the row of flow directing vanes and the raised land work in combination to cause substantially the entire quantity of steam which enters the chambers between teeth to pass through the row of flow directing vanes. The radial dimension of the vanes is greater than that of the raised land so that the bulk of the axial steam flow entering the seal passes directly into the vane row. However, the axial flow along the rotor surface impacts the raised land and is then deflected radially outward into the vicinity of the vane row. The outward deflected steam sweeps across the narrow annular gap between the teeth and the raised land and carries with it steam which would otherwise enter the seal through the annular gap. Entry of steam into the seal through the small working clearance of the gap is thereby minimized and substantially all of the seal steam thus enters through the vane row. With each vane appropriately angularly inclined (as will hereinafter be more fully defined) with respect to the rotor axis and direction of rotation, steam flow into the seal is forced to be in a circumferential direction counter to the direction of rotation. Thus, in at least a portion of the labyrinth seal, steam flow within the chambers between the annular teeth is caused to have a retrograde component counter to the direction of shaft rotation. This has the desired effect of producing stabilizing forces on the rotor to neutralize any destabilizing forces and effectively eliminates rotational instabilities caused by steam whirl.

In another aspect of the invention a multiplicity of seal rings are axially spaced-apart in proximity to each other along a portion of the rotor between regions of differential pressure. In this aspect of the invention, each seal ring includes a plurality of annular teeth as described above and at least one of the seal rings is provided with a row of flow directing vanes in the manner described above.

In contrast to many so-called gap seals of the prior art wherein a highly disordered, very turbulent flow is purposely generated to minimize leakage, the present invention makes use of means to provide a highly directed, very orderly flow.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which;

DETAILED DESCRIPTION OF THE INVENTION

Figure 1:
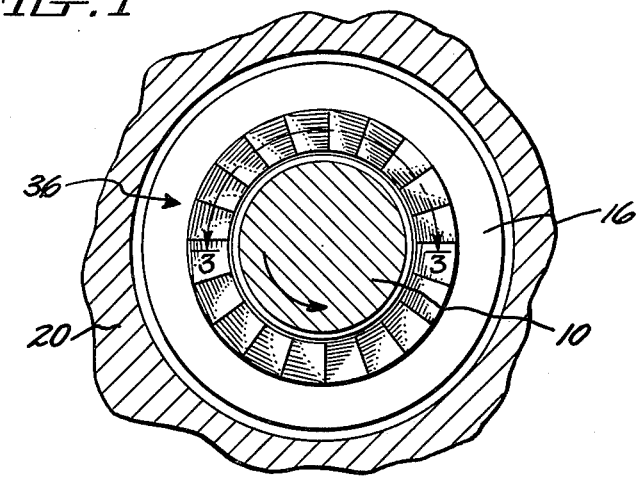
FIG. 1 is a partial sectional view, normal to the axis of rotation of a turbine including a preferred embodiment of stabilizing labyrinth sealing apparatus according to the invention and taken along the line 1—1 of FIG. 2.
Figure 2:
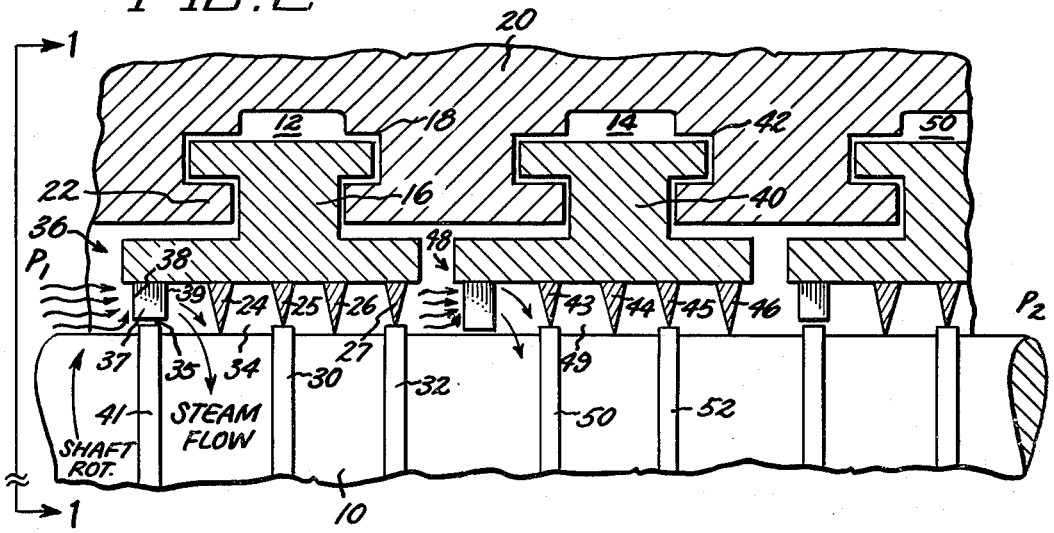
FIG. 2 is an enlarged, somewhat simplified partial sectional view of the preferred embodiment of FIG. 1.
Figure 3:
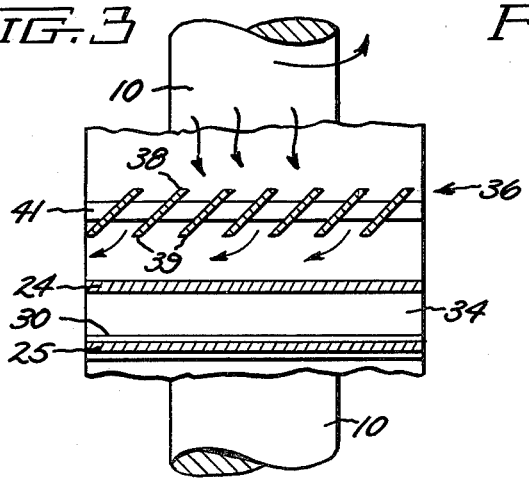
FIG. 3 is a developed plan view of the flow directing portion of one seal ring of the apparatus of FIG. 1 and taken along the line 3—3 of FIG. 1.

With reference to FIGS. 1, 2, and 3, showing a preferred embodiment of the invention, the rotor of a steam turbine includes rotating shaft 10 which extends from a region of higher fluid pressure at $P_1$ to a region of lower fluid pressure at $P_2$. While the full turbine rotor is not illustrated, it will be understood that shaft 10 is but a portion of the rotor which includes a full compliment of components (e.g., buckets) for extracting power of rotation from the motive fluid.

Displaced axially along the shaft 10 is a plurality of seal rings such as first and second seal rings 12 and 14, respectively. The exact number of seal rings utilized depends on a number of factors including the pressure to be sealed against and the desired sealing efficiency. Since the number of seal rings employed is not material to an understanding of the present invention, only first and second rings 12 and 14 are fully illustrated and only they will be discussed in detail herein. Each seal ring (e.g., rings 12 and 14) circumferentially encompasses the shaft 10 to minimize fluid leakage between the differential pressure regions through which the shaft 10 passes. For example, the plurality of seal rings including rings 12 and 14 may form the shaft end seals for the high pressure end of a steam turbine. All of the seal rings, such as rings 12 and 14, from a sealing viewpoint, function in substantially the same manner with the exception that some are exposed to slightly different pressures as a result of the pressure gradient running from $P_1$ to $P_2$. Seal ring 12, for example, includes a circumferential ring 16 which is H-shaped in cross-section (one leg of the H is somewhat truncated at both ends) to allow a mating fit with a T-shaped circumferential slot 18 in the stationary casing 20 of the turbine. The T-shaped slot 18 further includes conventional spring backing (not specifically illustrated) to force the H-shaped ring 16 radially inward toward the shaft 10. Shoulders 22 on the T-slot 18 limit the inward travel of the H-shaped ring 16.

Mounted on the radially inner side of the H-ring 16 are a series of spaced-apart annular teeth 24–27 which encircle the shaft 10. Two of the annular teeth 25 and 27 are correspondingly mounted opposite raised lands 30 and 32 to improve the sealing effectiveness of the overall seal 12. Annular teeth 24–27 are not in contact with the surface of shaft 10 but nevertheless extend to within very close proximity thereof to maintain a small working clearance between shaft and teeth, providing an effective seal against steam flow. An annular space or chamber is defined between the individual teeth 24–27 such as, for example, chamber 34 between teeth 24 and 25.

Also mounted on the radially inner side of H ring 16, nearest the high pressure end of H ring 16 (nearest $P_1$), is a plurality of circumferential spaced-apart flow directing vanes 36. Only a single vane 37 is shown in the view of FIG. 2; the full compliment of vanes 36 is illustrated in FIG. 1 and a portion thereof in FIG. 3. Each vane has a portion of its planar surface substantially radially aligned with respect to the rotor as illustrated in FIGS. 1, 2 and 3. Each vane, such as vane 37, is angularly inclined with respect to the rotor's axis so that the vane edge nearest the region of high pressure (i.e., the upstream edge and nearest $P_1$ in the case) is the trailing edge with respect to the direction of rotation of the shaft 10 (i.e., of the turbine rotor). For example, in FIG. 2 the direction of shaft rotation is as indicated and edge 38 of vane 37 is the trailing edge with respect to rotation, i.e., a line parallel to the axis of shaft 10 would cross a line through edge 38 after first crossing a line through the leading edge 39 of vane 37. These relationships are more clearly shown in the developed view of FIG. 3 wherein the arrowed line shows the rotor surface velocity vector (i.e., the direction of rotor rotation). Thus, it is clear that edges 38 of vanes 36 are the leading edges with respect to steam flow and the trailing edges with respect to rotor rotation. Edges 39, on the other hand, are the leading edges with respect to rotor rotation and the trailing edges with respect to steam flow.

Radially opposite the row of vanes 36, located on the rotor 10, is an annular raised land 41 substantially identical to lands 30 and 32, but which functions in combination with vane row 36 to direct steam into the chambers of seal ring 12. Most of the steam flow which enters the row 36 impinges directly on the flow directing vanes. However, there is an axial steam flow along the surface of rotor 10 which first strikes the raised land 41 and is then abruptly deflected radially outward toward the vane row 36. The outward deflected steam sweeps across the narrow annular gap 35 and carries with it any steam which would otherwise enter the seal ring 12 through the gap 35. Thus, the land 41 functions to ensure that substantially the entire quantity of steam which enters the seal 12 (i.e., the chamber between annular teeth 24–27, such as chamber 34) passes through the vane row 36.

The plurality of vanes 36 directs steam flow which enters the seal 12 so that flow is in a circumferential direction counter to the direction of rotor rotation. For example, in FIGS. 2 and 3 arrowed lines indicate the general direction of steam flow and show the steam entering the passageways between vanes 36 in a direction counter to shaft rotation. Generally, seal ring 12 is effective, from a sealing viewpoint, to make total fluid flow within the seal 12 relatively small. However, the flow that does enter the seal is in a flow direction, within one or more of the chambers (such as chamber 34 between teeth 24 and 25), counter to the direction of shaft rotation. While this retrograde component of fluid whirl does not prevent pressure gradients within the chambers between teeth 24–27, it does have the effect of shifting the lateral forces with respect to shaft displacement within the seal so that these forces are not destabilizing. In other words, the phase relationship between lateral movement of the shaft and lateral forces on the shaft is shifted in a manner so that instability is prevented. It can be reiterated at this point that the natural tendency, for some turbines under higher load levels, is for steam flow to be strongly in the direction of rotor rotation, with the fluid entering seal 12 whirling in that direction. The steam is further urged to flow in that direction by the viscous drag of the rotating shaft 10.

The second labyrinth seal ring 14 functions in the manner described above but steam enters the seal 14 at a somewhat lower pressure since seal 14 is displaced nearer the lower end of the pressure differential between $P_1$ and $P_2$. In addition, seal ring 14 does not include an annular raised land opposite the vane row 48. Although it is preferable that such a land be provided, in a retrofit situation wherein adaptations are being made to an installed turbine, it is advantageous to avoid modifications to the turbine rotor. In that regard, it will be recognized by those of skill in the art that certain elements of the present invention may pre-exist in a turbine. For example, raised lands 50 and 52 may previously exist as components of a sealing arrangment. Thus, the present invention is adaptable to the particular rotor configuration without the necessity of requiring modifications to the rotor (i.e., no machine work is required directly on the rotor). For an installed turbine, the seal rings are structured in accordance with the present invention and existing raised lands on the rotor are therefore used to advantage regardless of their pre-existing axial location.

Describing seal ring 14 further, it includes H-ring 40 fitted into T-slot 42 and annular teeth 43–46 affixed to the H-ring 40 in a conventional manner. The plurality of vanes 48 are provided in the manner of vanes 36 of seal 12 to direct the steam flow entering the chambers (e.g., chamber 49) of seal 14 in a retrograde direction as the arrowed lines indicate. Vanes 48, as well as vanes 36, are affixed to corresponding H-rings 40 and 16 in a conventional manner. Rotating annular raised lands 50 and 52 are rotatable with shaft 10 and provide effective sealing to minimize total fluid flow in the seal 14.

The retrograde whirl imparted to steam entering seal 14 is effective to prevent destabilizing lateral forces on the shaft 10 which otherwise accompany high levels of forward fluid whirl in the chambers between teeth 43–46 (e.g., chambers 49 between teeth 43 and 44) and between vanes 48 and tooth 43.

It will be apparent to those of ordinary skill in the art that additional seals such as seals 12 and 14 can be provided in series fashion along the shaft 10 between regions of differential pressure. One such seal ring 50, substantially identical to ring 12, is partially shown in FIG. 2. In general, the number of separate seal rings is determined by the need to prevent excess steam leakage. It will also be recognized that vanes, such as vanes 36 and 48, can be provided at locations within the seals 12 and 14 other than at the particular upstream locations shown. For example, tooth 25 of seal 12 can be replaced with a plurality of circumferential spaced-apart vanes to further ensure that a retrograde whirl is imparted to the steam within the seal 12. In effect, a row of vanes such as vane 36 of FIGS. 1 and 2, can be interposed between at least two of the annular teeth. In addition, and as a practical matter, one of the annular teeth, such as tooth 25, can be divided into arcuate segments forming flow directing vanes with each such vane angularly inclined to cause the steam flow to be counter to rotor rotation.

The present invention provides an improved labyrinth sealing apparatus for a steam turbine which is effective to prevent motor instabilities of the type produced by steam whirl within the chambers of the seal and which is particularly well suited for field installation as a retrofit to cure rotor stability problems which limit operation of the turbine to load levels below its rated capacity. Steam entering the seal is highly directed and orderly to achieve the desired result. An important advantage of the invention is that it does not depend for its effectiveness upon the introduction of a second component of steam flow into the seal.

Figure 4:
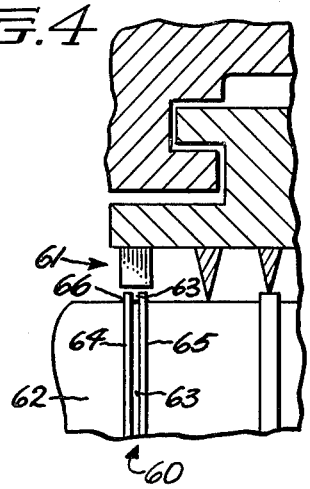
FIG. 4 is a partial sectional view illustrating an alternative configuration for a raised annular land of the invention.

Thus, while there has been shown and described what is considered to be a preferred embodiment of the invention, it is understood that various other modifications may be made therein. For example, FIG. 4 illustrates an alternative configuration for a raised annular land 60 opposite a flow directing vane row 61. The configuration of FIG. 4 is analagous to that of FIGS. 1, 2, and 3. However, the raised land 60 on rotor 62 is contoured to include a central groove 63 dividing the land 60 into two annular sections 64 and 65. In addition the upstream side of the land 60 is formed with a curved surface 66 for better aerodynamic deflection of the steam radially outward. Although the embodiment of FIG. 4 is not particularly suited for retrofit use, there is the added advantage that the contact area between the vane row and the raised land is reduced in the event these parts begin to rub upon each other during turbine operation. It is intended to claim all modifications such as those of FIG. 4 which fall within the true spirit and scope of the present invention.

The invention claimed is:

1. For use in a steam turbine having a central rotatable rotor, a labyrinth seal for minimizing leakage of the steam between a region of higher pressure and a region of lower pressure through which the rotor extends, such seal providing stabilization against rotational instabilities of the type caused by steam whirl and comprising, in combination:

a plurality of spaced-apart annular teeth affixed to a stationary portion of the turbine between said pressure regions and encircling the rotor substantially coaxially therewith to define chambers between the teeth, each tooth of said plurality of teeth extending radially inward to within close proximity of said rotor;

a row of circumferentially spaced-apart flow directing vanes affixed to the stationary portion of the turbine within said higher pressure region and encircling the rotor in proximity to said plurality of said annular teeth, each vane of said row having a portion of its planar surface being substantially radially aligned with respect to said rotor, and said planar surface of said vane being angularly inclined with respect to the axis of said rotor to direct steam passing therethrough into said chambers in a flow direction counter to the direction of rotor rotation; and a raised annular land on the rotor surface opposite said row of vanes to produce an abrupt radially outward deflection of the steam flow passing axially near the surface of the rotor, the resultant outward flow being carried into the vacinity of said row of vanes so that substantially the entire flow of steam entering said chambers passes through said vane row and enters in a direction counter to the direction of rotor rotation.

2. The labyrinth seal of claim 1 wherein each vane of said row of flow directing vanes extends radially inward to within close proximity of said raised annular land and the angular inclination of each vane is such that the vane edge upstream with respect to steam flow is the trailing edge with respect to rotor rotation.

3. The labyrinth seal of claims 1 or 2 wherein said annular land is contoured to form first and second annular sections defining a central groove therebetween, the first annular section being disposed adjacent said higher pressure region and having an aerodynamically shaped surface for smoothly deflecting said axial steam flow.

4. In combination with a labyrinth seal for the rotor of a steam turbine wherein the seal is of a type including a plurality of spaced-apart annular teeth affixed to a stationary portion of the turbine between the regions of higher and lower steam pressure between which the turbine rotor extends, apparatus for preventing rotor instabilities caused by forward running steam whirl within such seal, the apparatus comprising:

a row of circumferentially spaced-apart flow directing vanes affixed to the stationary turbine portion within the higher pressure region and encircling the rotor in proximity to said plurality of annular teeth, each vane of said row having a portion of its planar surface being substantially radially aligned with respect to said rotor, and said planar surface of said vane being angularly positioned with respect to the axis of the rotor to direct steam flow passing through said row of vanes into said seal in a direction counter to the direction of rotor rotation; and a raised annular land located on the rotor opposite said row of vanes and extending radially outward to within close proximity of said row of vanes, for deflecting axial steam flow from along the surface of the rotor radially outward around said row of vanes so that substantially the entire flow of steam entering said seal passes through said row of vanes.

5. The apparatus of claim 4 wherein each vane of said row of flow directing vanes is angularly positioned such that the vane edge nearest the higher pressure region is the trailing edge with respect to rotor rotation.

6. The apparatus of claims 4 or 5 wherein said raised annular land is contoured to form first and second annular sections defining a central groove therebetween, the first annular section being disposed adjacent said higher pressure region and having an aerodynamically shaped surface immediately adjacent said higher pressure region for smoothly deflecting said axial steam flow.

7. For use with a steam turbine having a central rotatable rotor, a labyrinth sealing apparatus for minimizing leakage between regions of higher and lower pressure between which the rotor extends and for preventing rotational instabilities due to steam whirl within the seal, such apparatus comprising:

a multiplicity of seal rings affixed to a stationary portion of a turbine between said higher and lower pressure regions and spaced-apart in proximity to each other along the axis of the rotor to define a higher pressure side and a lower pressure side of each ring, each seal ring including a plurality of spaced-apart annular teeth encircling the rotor and extending radially inward to within close proximity of the rotor surface to define chambers between teeth;

at least one of said seal rings includes a row of circumferentially spaced-apart flow directing vanes encircling the rotor on the higher pressure side of said at least one ring, each vane of said row extending radially inward to within close proximity of the rotor surface, each vane having a portion of its planar surface being substantially radially aligned with respect to said rotor, and said planar surface being angularly inclined with respect to the axis of said rotor to direct steam entering said at least one ring into the chambers thereof in a flow direction counter to rotor rotation; and at least one raised annular land located on the rotor opposite said row of vanes and extending radially outward to within close proximity of said row of vanes, for deflecting axial steam flow from along the surface of the rotor radially outward around said row of vanes so that substantially the entire flow of steam entering said seal ring passes through said row of vanes.

8. The labyrinth sealing apparatus of claim 7 further including, in combination with said at least one seal ring, a raised annular land on the rotor surface opposite said row of vanes to produce an abrupt radially outward deflection of the steam flow passing axially near the surface of the rotor, the resultant toward flow being carried into the vicinity of said row of vanes so that substantially the entire flow of steam entering said chambers passes through said vane row.

9. The labyrinth sealing apparatus of claim 8 wherein each vane of said row of flow directing vanes extends radially inward to within close proximity of said raised annular land and the angular inclination of each vane is such that the vane edge upstream with respect to steam flow is the trailing edge with respect to rotor rotation.

10. The labyrinth sealing apparatus of claims 8 or 9 wherein said raised annular land is contoured to form first and second annular sections defining a central groove therebetween, the first annular section being disposed adjacent said higher pressure region and having an aero-dynamically shaped surface immediately adjacent said higher pressure region for smoothly deflecting said axial steam flow.

* * * * *